US006017062A

United States Patent [19]

White

[11] Patent Number: 6,017,062

[45] Date of Patent: Jan. 25, 2000

[54] DAY PLANNER WITH A PARTITIONED PHOTO COMPARTMENT

[75] Inventor: Lew E. White, Dayton, Ohio

[73] Assignee: The Mead Corporation, Dayton, Ohio

[21] Appl. No.: 09/192,800

[22] Filed: Nov. 16, 1998

[51] Int. Cl.[7] ..... B42D 3/00

[52] U.S. Cl. ..... 281/29; 281/31; 402/73

[58] Field of Search ..... 281/21.1, 15.1, 281/29, 31, 36, 37, 45; 402/70, 73, 80 R; 283/36–42; 150/104; 206/214

[56] References Cited

U.S. PATENT DOCUMENTS

| | | | |
|---|---|---|---|
| D. 138,713 | 9/1944 | Klein et al. | D74/5 |
| D. 159,763 | 8/1950 | Turpin | D6/2 |
| D. 268,347 | 3/1983 | Marsh | D19/27 |
| D. 294,430 | 3/1988 | Tell | D3/35 |
| D. 303,809 | 10/1989 | Klein | D19/27 |
| D. 344,096 | 2/1994 | Tan | D19/26 |
| D. 382,900 | 8/1997 | Wyant | D19/27 |
| 2,016,053 | 10/1935 | Schaeffer | 150/28 |
| 2,018,551 | 10/1935 | Freling | 45/57 |
| 2,755,837 | 7/1956 | Kosek | 150/1.6 |
| 2,803,281 | 8/1957 | Sutton | 150/35 |
| 4,974,983 | 12/1990 | Givati | 402/80 |
| 5,236,226 | 8/1993 | Sheffield | 281/31 |
| 5,240,340 | 8/1993 | Lynch et al. | 281/31 |
| 5,333,908 | 8/1994 | Dorney et al. | 283/38 |
| 5,409,153 | 4/1995 | Ristich | 224/253 |
| 5,480,024 | 1/1996 | Hertema | 206/232 |
| 5,489,021 | 2/1996 | Wallingford | 206/214 |
| 5,713,684 | 2/1998 | Turecamo | 281/31 X |
| 5,772,247 | 6/1998 | Legrand | 281/31 |
| 5,911,441 | 6/1999 | Yamamoto et al. | 402/73 X |

*Primary Examiner*—Willmon Fridie, Jr.
*Attorney, Agent, or Firm*—Thompson Hine & Flory LLP

[57] ABSTRACT

The invention provides a day planner for holding calendar pages, papers, notes, cards, etc., which includes a separate compartment for holding photographs. More particularly, the present invention provides a day planner that has front and back covers that are attached to a central spine. The interior of the day planner is partitioned by a divider into a pair of compartments, one of which includes a binder for securing calendar pages, notes, addresses, etc. and the other of which includes a plurality of photo album pages. Additionally, fasteners are provided for keeping each compartment closed and for securing the contents of each compartment in the planner.

13 Claims, 5 Drawing Sheets

DAY PLANNER WITH A PARTITIONED PHOTO COMPARTMENT

BACKGROUND OF THE INVENTION

This invention relates to a day planner for holding calendar pages, papers, notes, cards, etc., which includes a separate compartment for holding photographs. More particularly, the present invention provides a day planner that has front and back covers that are attached to a central spine. The interior of the day planner is partitioned by a divider into a pair of compartments, one of which includes a binder for securing calendar pages, notes, addresses, etc. and the other of which includes a plurality of photo album pages. Additionally, fasteners and closures are provided for keeping each compartment closed and for securing the contents of each compartment in the planner.

In the past there have been day planners and the like that have included binders for holding calendar pages, addresses , etc. Typically, these planners are equipped with additional features such as pockets for holding business cards, credit cards, etc. as well as additional items such as a note pad or pens and pencils. Planners such as these have been designed with the goal of helping their users to "get organized" and have proved invaluable to many people in the business world. Accordingly, these types of planners have become almost ubiquitous in the corporate world, their popularity and acceptance growing to the point that they are as common in the business world as the briefcase. Some manufacturer's of these types of planners, and even some schools as well, have gone so far as to offer courses in the most constructive and efficient use of them. An example of this type of planner is disclosed in U.S. Pat. No. 5,333,908 to Domey et al. which discloses an information management system consisting of specialized calendar and note pages that are replaceable and are held within a ring-type binder.

Also well known are many ways of storing and displaying photographs in a binder or folio, such as a photo album. Typically, prior art photo albums consist of a plurality of "pages" that include a translucent plastic facing. Thus, the photos may be placed under the facing thereby protecting them from fingerprints, dust, etc. while still allowing them to be easily viewed. Often times, in order to facilitate insertion and arrangement of the photographs, these pages are separated into individual sleeves that are shaped to accommodate a single photograph. An example of a photo album of this type is shown in U.S. Pat. No. Des. 344,096 to Tan which discloses a photo album having photo album pages with sleeves for storing individual photographs. The photo album pages of the Tan invention are secured in a ring-type binder and are protected by front and back covers that may be releasably secured together by a tab-type fastener.

Now, with the growing amount of business that is accomplished "on the go" and the advent of the "virtual office", increasing numbers of corporate workers are finding themselves unleashed from the standard office environment complete with the big desk, the credenza, and the obligatory framed family photos and snapshots. Thus, these on the go businesspeople have found a need to carry around personal photographs of family in an easily accessible area. Needless to say, due to the increasing popularity of the above-mentioned personal organizer type day planners and the fact that these planners are almost always found in close proximity to their owners, these planners have become the preferred location for placing family photographs. This practice is not without its share of problems, though. For one, the pictures are usually just stuck in any convenient area in the planner, usually between pages in the calendar, and are not very well protected. This generally leads to the pictures becoming tattered and ruined. Also, the pictures so placed are susceptible to sliding out of the planner and can subsequently become lost or damaged. Furthermore, the planner can become a jumbled mess of pictures and other items, contributing to the disorganization that the planner was originally meant to solve.

One way to solve this problem would be to include photo sleeves or photo album pages in the binder with the calendar pages. However, these photos would still be subject to some every day wear and tear from the constant use of the calendar pages. Additionally, in some circumstances the display of personal pictures can be thought to be unprofessional, while in other circumstances, they can be used advantageously as a way to "break the ice" or to place a business relationship on a more personal level. Thus, while it is desired to have the pictures in an accessible place at all times, it is also desired to be able to isolate them in an area where they are safe from harm and cannot be seen.

Accordingly, there is a need for a product which combines the benefits of a planner with the attributes of a photo album. For example, it would be desirable to have a product which is capable of holding calendar pages, papers, notes, cards, etc., and which includes a separate compartment for holding photographs. More particularly, it would be desirable to have a day planner that has one compartment including a binder for securing calendar pages, notes, etc. that is separated by a divider from a second compartment which is designed for holding photo album pages. Preferably, each of the two compartments could be individually closed so that each compartment could be separately accessed without the need to open the other compartment. In this way, privacy with respect to the photo compartment could be maintained if access to the planner was required in a business setting where personal pictures would be found inappropriate. Furthermore, the fragile photos in the photo compartment would be protected from exposure to the constant wear and tear caused by use of the calendar compartment. In a preferred embodiment, a zippered gusset would be provided around the calendar compartment so that small pieces of paper such as notes, addresses, etc. as well as pens and pencils would be captured when the gusset is zippered shut thus preventing their loss.

SUMMARY OF THE INVENTION

In accordance with the present invention, a day planner is provided which is partitioned into separate photo and calendar compartments. More particularly, the present invention provides a day planner that has front and back covers that are attached to a central spine. The interior of the day planner is partitioned by a divider into a pair of compartments, one of which includes a binder for securing calendar pages, notes, addresses, etc. and the other of which includes a plurality of photo album pages. Additionally, fasteners are provided for keeping each compartment closed and for securing the contents of each compartment in the planner.

In a preferred embodiment of the present invention, the front and back covers, the divider, and the central spine are composed of a rigid substrate such as a heavy cardboard backing which is covered by a material such as fabric, plastic or leather. A soft padding may be provided between the cover and the backing. Most preferably, individual pieces of the substrate are used to form the front cover, central spine, back cover, and divider which are sewn to and held together by a covering with padding interposed between the leather and the substrate. In a preferred embodiment, a seamless piece of covering material is used to form the outer facing for the front cover, central spine, and back cover, and a separate seamless piece is used form the inner facing of the front cover and is extended therefrom to form to cover the divider. Both the front and back covers are preferably covered in a leather or fabric, or a leather simulating plastic.

The calendar compartment is enclosed by the lower side of the divider, the central spine, and the inner side of the back cover. A ring-type binder is fixedly attached to the central spine and a zippered gusset encloses the entire calendar compartment. Preferably, the inside facing of the back cover includes a slot for receiving a back board of a note pad and the inside facing of the lower side of the divider has a flap with slots cut therein for holding credit cards, business cards, etc.

The photo compartment is enclosed by the upper side of the divider and the inner side of the front cover. A storage flap is attached to the outside corner of the inner side of the front cover for holding papers or additional photographs. Preferably, a slot is cut into the inside facing of the front cover for receiving a rigid tongue which is hingedly attached to a plurality of photo album pages. The photo album pages are provided with sleeves for receiving individual photos which can be formed in any conventional manner. In a preferred embodiment, a belt is secured between the facings of the divider and extends therefrom and is equipped with a fastener, such as a snap, so that the belt may be fastened to the top of the front cover thereby securing the photo compartment in a closed position. Thus, the calendar compartment of the planner may be unzipped and opened without revealing the photos in the photo compartment. Depending on the flexibility and dimensions of the divider and front cover, the divider may be fastened directly to the front cover, for example by using a snap, without using the belt.

These and other objects and advantages of the present invention will be more fully understood and appreciated by reference to the following description, the accompanying drawings and the appended claims.

DETAILED DESCRIPTION

Figure 1:
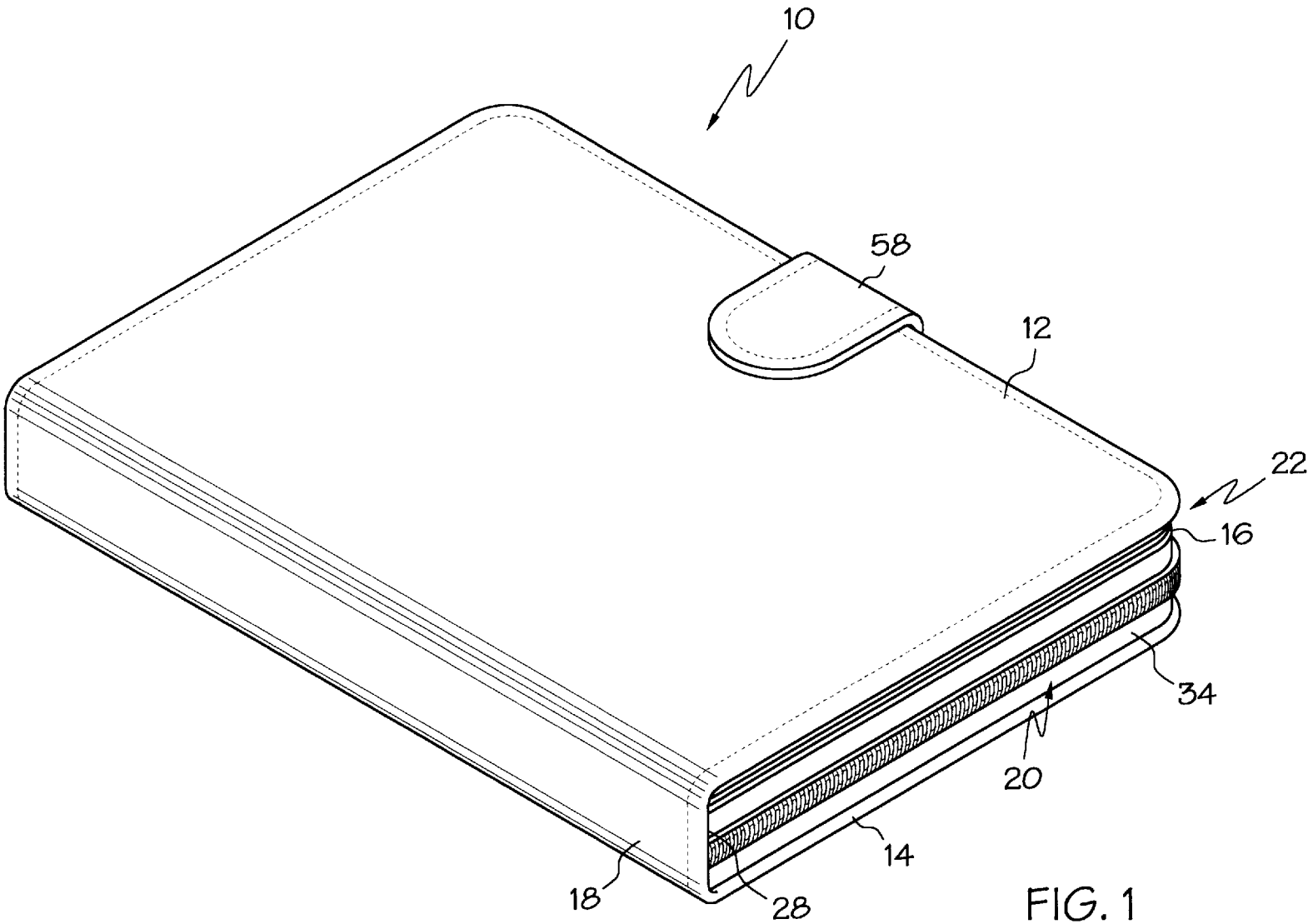
FIG. 1 is a side perspective view of a closed day planner having a partitioned photo compartment in accordance with the present invention.
Figure 2:
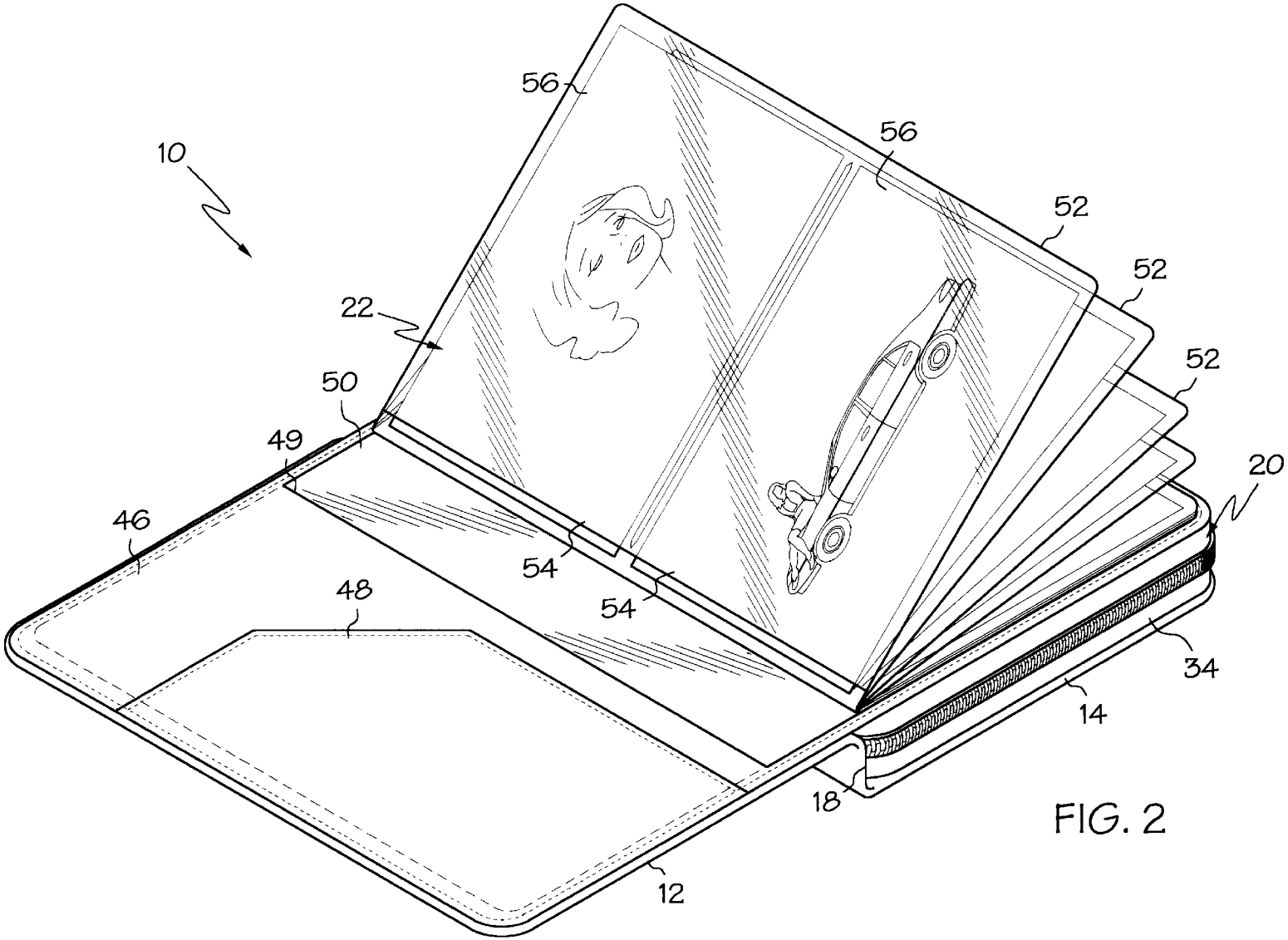
FIG. 2 is a side perspective view of the day planner of FIG. 1 shown with the photo compartment in an open position.
Figure 3:
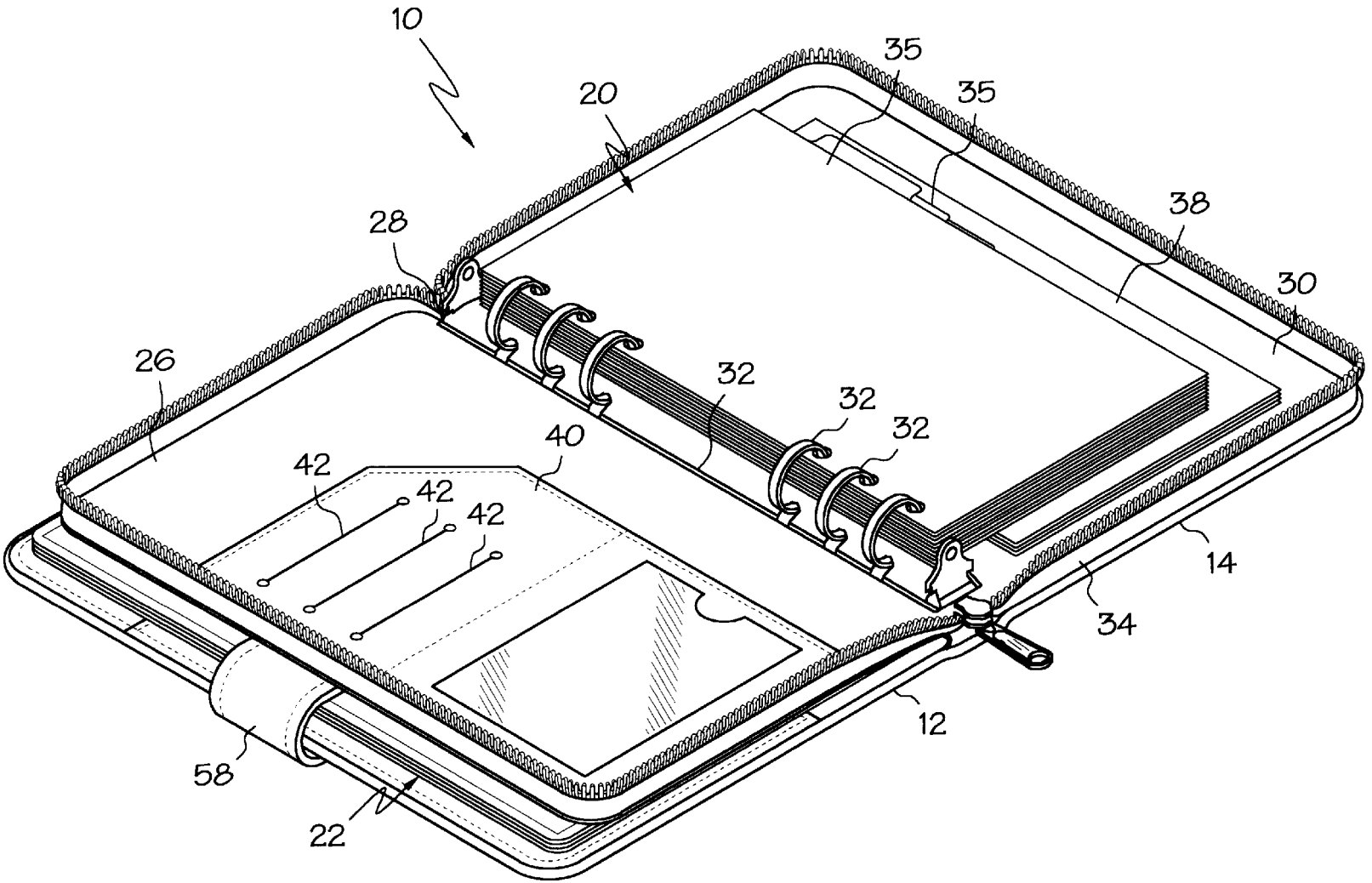
FIG. 3 is a side perspective view of the day planner of FIG. 1 shown with the calendar compartment in an open position.

Referring to FIGS. 1, 2 and 3, the day planner of the present invention, generally designated 10, includes a front cover 12, a back cover 14, a divider 16, and a central spine 18. The divider 16 acts as a partition to separate the day planner 10 into a calendar compartment 20 and a photo compartment 22. The front cover 12 is hingedly attached to the central spine 18 which is hingedly attached to the back cover 14. In a preferred embodiment, as best seen in FIGS. 4 and 5, the divider 16 is attached to the front cover by a seamless piece of facing material 24 which extends the length of the front cover 12 and is sewn thereto.

In a preferred embodiment of the present invention, the front and back covers 12, 14, the divider 16, and the central spine 18 are composed of a rigid substrate boards (not shown) covered in a fabric such as nylon, leather or a plastic such a vinyl.

As best seen in FIG. 3, the calendar compartment 20 is enclosed by the lower side 26 of the divider 16, the inside 28 of the central spine 18, and the inner side 30 of the back cover 14. A ring-type binder 32 is fixedly attached to the central spine 16 and a zippered gusset 34 encloses the entire calendar compartment 20. Calendar pages 35 are held within the binder 32. Preferably, the inner side 30 of the back cover 14 includes a slot 36 for receiving a tongue (not shown) of a note pad 38 and the lower side 26 of the divider 16 has a flap 40 with slots 42 cut therein for holding credit cards, business cards, etc.

Figure 4:
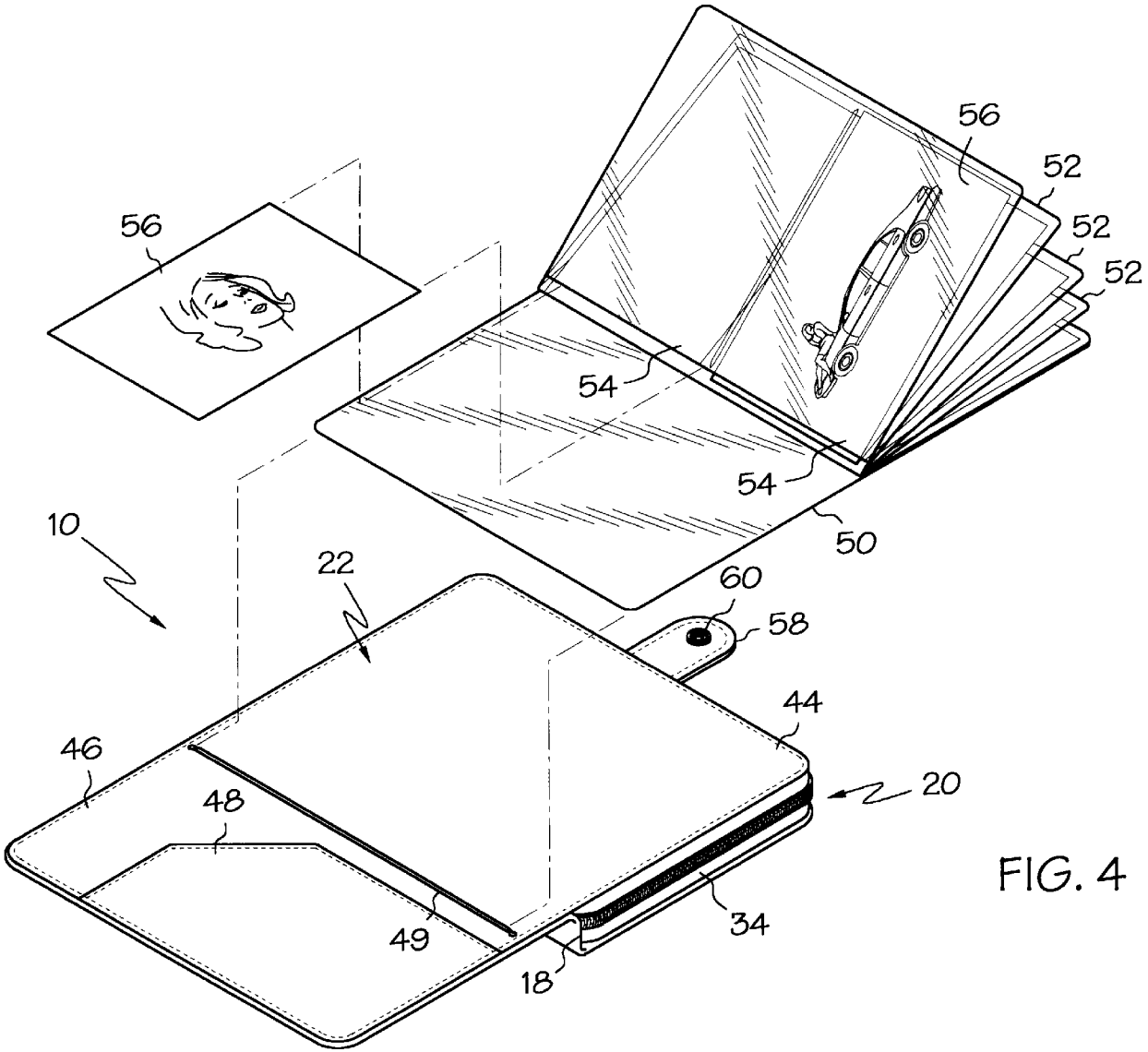
FIG. 4 is a side perspective view of the day planner of FIG. 1 depicting the insertion of the photo album pages into the front cover of the planner.
Figure 5:
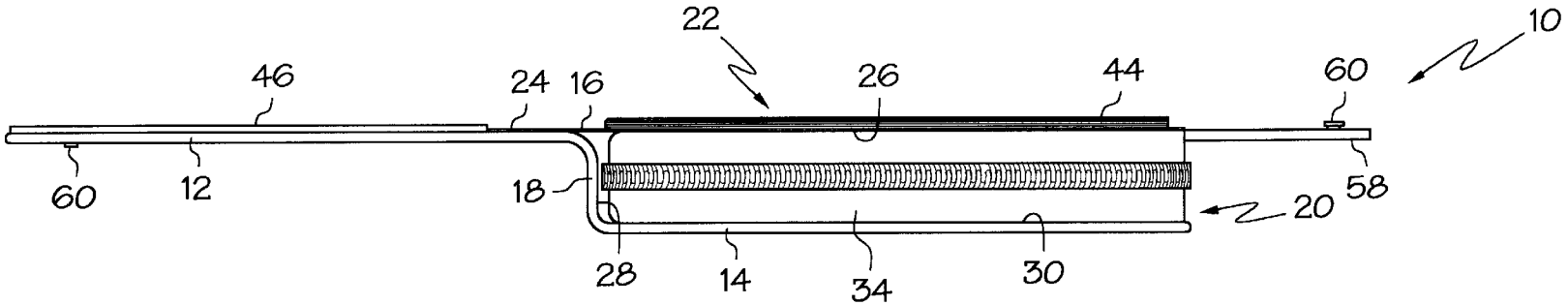
FIG. 5 is a side elevational view of the day planner of FIG. 1 shown with the photo compartment in an open position.
Figure 6:
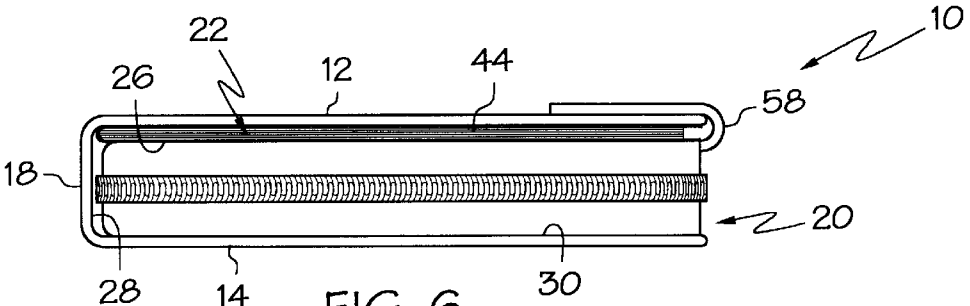
FIG. 6 is a side elevational view of the day planner of FIG. 1 shown with the photo compartment in a closed position.
Figure 7:
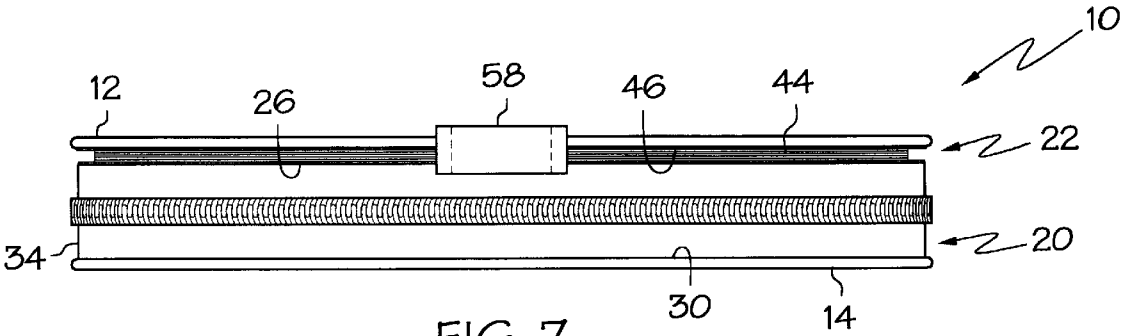
FIG. 7 is a front elevational view of the day planner of FIG. 1 shown with the photo compartment in a closed position.

As best seen in FIGS. 2 and 4, the photo compartment 22 is enclosed by the upper side 44 of the divider 16 and the inner side 46 of the front cover 12. A storage flap 48 is attached to the outside corner of the inner side 46 of the front cover 12 for holding papers or additional photographs. Preferably, a slot 49 is cut into the inner side 46 of the front cover 12 for receiving a rigid tongue 50 which is hingedly attached to a plurality of photo album pages 52. The photo album pages 52 are separated into sleeves 54 for receiving individual photos 56. In a preferred embodiment, a belt 58 is secured between the facings of the divider 16 and extends therefrom. The belt 58 is equipped with a fastener, such as a snap 60, so that the belt 58 may be fastened to the top of the front cover 12. When snap 60 is fastened the belt 58 secures the front cover 12 in a closed position. Other conventional means for fastening the front cover 12, such as hook and loop material, are known and are considered within the scope of the invention. Thus, the calendar compartment 20 of the planner 10 may be unzipped and opened without revealing the photos 56 in the photo compartment 22.

While the form of the apparatus herein described constitutes a preferred embodiment of the invention, it is to be understood that the invention is not limited to this precise form of apparatus, and that changes may be made therein without departing from the scope of the invention.

What is claimed is:

1. A day planner comprising:

a front cover having an inner side and an outer side and a back cover having an inner side and an outer side, said covers being foldably joined together by a central spine;

a divider having an upper side and a lower side interposed between said front cover and said back cover;

a plurality of photo album pages interposed between said front cover inner side and said divider upper side;

a binder attached to said spine between said divider lower side and said back cover inner side; and a fastener attached to said divider for securing said front cover to said divider thereby capturing said photo album pages between said front cover and said divider.

2. The day planner of claim 1 wherein said divider is attached to said front cover by a facing material which extends the length of said front cover and is sewn thereto so that said front cover and divider are foldable in a parallel planar relationship along a line parallel to said spine.

3. The day planner of claim 1 wherein said front cover inner side includes an inner facing having a slot formed therein for insertion of a tongue that is hingedly attached to said photo album pages.

4. The day planner of claim 3 further comprising a storage flap attached to said inner side of said front cover.

5. The day planner of claim 1 wherein said fastener is a belt that extends from said divider and can be releasably attached to said front cover.

6. The day planner of claim 5 wherein said belt is releasably attached to said front cover by a restraint selected from the group consisting of snaps, magnets, hook and loop material, buttons, zippers and clasps.

7. The day planner of claim 6 wherein said restraint is a snap.

8. The day planner of claim 1 further comprising a gusset having a top portion attached to said divider lower side and a bottom portion attached to said back cover inner side wherein said gusset top portion and bottom portion may be releasably closed by a closure.

9. The day planner of claim 8 wherein said closure is selected from the group consisting of snaps, magnets, hook and loop material, buttons, zippers and resilient clasps.

10. The day planner of claim 9 wherein said closure is a zipper.

11. The day planner of claim 1 further comprising calendar pagers for insertion in said binder.

12. The day planner of claim 1 further comprising an inner flap attached to said bottom side of said divider.

13. The day planner of claim 1 wherein said back cover inner side includes an inner facing having a slot formed therein for insertion of a tongue that is attached to a notebook.

* * * * *